US006219005B1

(12) United States Patent
Szafranek

(10) Patent No.: US 6,219,005 B1
(45) Date of Patent: Apr. 17, 2001

(54) METHOD AND APPARATUS FOR REDUCING SIDELOBES OF ANTENNAS WITHIN RADOMES

(75) Inventor: Igor Szafranek, Karmiel (IL)

(73) Assignee: Rafael-Armament Development Authority, Ltd., Haifa (IL)

( * ) Notice: Subject to any disclaimer, the term of this patent is extended or adjusted under 35 U.S.C. 154(b) by 0 days.

(21) Appl. No.: 08/334,364

(22) Filed: Nov. 3, 1994

(30) Foreign Application Priority Data

Nov. 5, 1993 (IL) ..... 107506

(51) Int. Cl.[7] ..... H01Q 1/42
(52) U.S. Cl. ..... 343/872; 343/705
(58) Field of Search ..... 343/705, 708, 343/833, 831, 872, 912

(56) References Cited

U.S. PATENT DOCUMENTS

| | | | | |
|---|---|---|---|---|
| 3,101,473 | | 8/1963 | Fenlon, Jr. | 343/760 |
| 3,852,756 | * | 12/1974 | Reese | 343/708 |
| 3,936,835 | * | 2/1976 | Phelan | 343/833 |
| 4,091,388 | * | 5/1978 | Fiscus | 343/872 |
| 4,231,043 | | 10/1980 | Semplak | 343/786 |
| 4,282,530 | * | 8/1981 | Semplak | 343/872 |
| 4,386,356 | | 5/1983 | Tricoles et al. | 342/445 |
| 4,460,901 | * | 7/1984 | Tricoles et al. | 343/872 |
| 4,570,166 | * | 2/1986 | Kuhn et al. | 343/872 |
| 4,749,997 | * | 6/1988 | Canonico | 343/705 |
| 4,916,461 | * | 4/1990 | Brazel | 343/872 |
| 4,949,094 | * | 8/1990 | Yukl | 343/833 |
| 5,167,386 | * | 12/1992 | Laquer et al. | 343/872 |
| 5,173,699 | * | 12/1992 | Barr et al. | 343/872 |
| 5,184,137 | | 2/1993 | Pozgay | 342/174 |
| 5,185,608 | | 2/1993 | Pozgay | 342/17 |
| 5,223,842 | | 6/1993 | Okurowski et al. | 342/201 |

FOREIGN PATENT DOCUMENTS

| | | | | |
|---|---|---|---|---|
| 0201406 | * | 11/1983 | (JP) | 343/872 |

* cited by examiner

*Primary Examiner*—Tan Ho
(74) *Attorney, Agent, or Firm*—Mark M. Friedman

(57) ABSTRACT

A method of reducing sidelobes of an antenna induced by a blockage in a radome covering the antenna, which includes providing at least one passive tuning element between the antenna and the blockage, and adjusting the position of the tuning element to reduce the blockage-induced sidelobes. An antenna apparatus which includes an antenna, a radome covering the antenna and including a blockage tending to induce a sidelobe in the radiation pattern of the antenna, and at least one passive tuning element between the antenna and the blockage for reducing the blocking-induced sidelobes.

26 Claims, 1 Drawing Sheet

METHOD AND APPARATUS FOR REDUCING SIDELOBES OF ANTENNAS WITHIN RADOMES

FIELD AND BACKGROUND OF THE INVENTION

The present invention relates to antennas and radomes, and particularly to a method and apparatus for reducing sidelobes of an antenna covered by a radome.

Radomes are structures designed to cover antennas and thereby to protect them from direct exposure to aerodynamic and environmental conditions, while being as transparent as possible to the antenna's electromagnetic (EM) radiation. However, many types of radomes include various forms of discontinuities or blockages. For example, radomes on high-speed, airborne platforms are usually equipped with a metallic tip to protect the radome against rain erosion, and/or with a pitot probe to measure the pressure of the fluid stream. Dual-sensor infrared/radio frequency (IR/rf) homing systems may include an IR seeker mounted at the radome's nose area. Small Streamline radomes commonly include dimensional and geometrical constraints which lead to an EM discontinuity in the radome's nose area. In all the above radome constructions, the radome may produce a blockage at the antenna's aperture.

When illuminated by the main beam of the antenna, the blockage acts as a secondary source that radiates in antiphase to the primary beam of the antenna. The exact pattern of this new source depends on the blockage dimensions. This radiation pattern interferes with the antenna's main beam and sidelobes, leading to degradation in the gain and sidelobes levels of the antenna's radiation pattern.

An object of the present invention is to provide a method, and also apparatus, for reducing the sidelobes of an antenna induced by such blockages in a radome.

SUMMARY OF THE INVENTION

According to the present invention, there is provided a method of reducing sidelobes of an antenna induced by a blockage in a radome covering the antenna, comprising providing at least one passive tuning element between the antenna and the blockage, and adjusting the position of the tuning element to reduce the blockage-induced sidelobes.

According to further features in the preferred embodiment of the invention described below, the passive tuning element is provided along the line of sight between the antenna and the blockage. Preferably, the passive tuning element is a circular metal member coaxial with the line of sight between the antenna and the blockage and is supported on a thin metal rod coaxial with the line of sight.

As will be described more particularly below, the provision of such a passive tuning element substantially reduces the sidelobes of an antenna produced by the above-described blockages in a radome. A single tuning element reduces sidelobes in a narrow angular range, but may cause energy increase of adjacent sidelobes. According to a further feature of the present invention, a broader angular effect may be achieved by using multiple tuning elements. Thus, the interelement distance shifts the angular position of the sidelobe null; the larger the separation between the discs, the closer the null to the mainlobe.

The radii of the passive tuning elements are typically about the same order as the blockage radius, preferably between 0.5 and 1.5 times of the blockage radius. In addition, the tuning elements are preferably spaced from the radome tip, and from each other, a distance of about 0.5 to 1.5 the operating (middle) wavelength of the antenna.

The invention also provides apparatus including an antenna and a radome, in which the sidelobes induced by the blockage in the radiation pattern of the antenna are reduced according to the above method.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
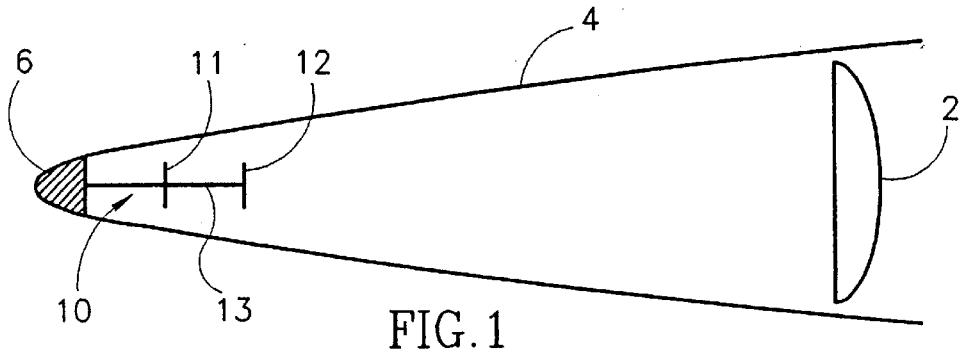
FIG. 1 schematically illustrates an antenna system including a radome, in which sidelobes of the antenna induced by a metal rain tip of the radome are reduced in accordance with the present invention.

FIG. 1 schematically illustrates an antenna 2, as might be carried by an airborne platform such as an aircraft or missile, enclosed by a radome 4 to protect the antenna from direct exposure to aerodynamic and environmental conditions. Radome 4 may be provided with a metal tip 6 to protect the radome against erosion caused by rain.

As briefly described above, such a construction of antenna and radome is conventional. However, as also described above, the metal tip 6 of the radome 4, provided to protect the radome against rain erosion, produces a discontinuity or blockage in the radome's tip or nose area, which induced undesirable sidelobes in the antenna radiation pattern. Such sidelobes can be reduced by the provision of a passive tuning device, generally designated 10 in FIGS. 1 and 2, within the radome 4 between the blockage 6 and the antenna 2.

Figure 2:
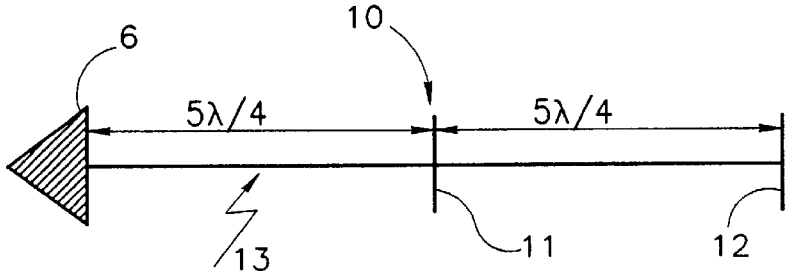
FIG. 2 more particularly illustrates the parameters of the passive tuning elements included in the antenna system of FIG. 1.

In the construction illustrated in FIGS. 1 and 2, the passive tuning device 10 is a two-element device. It includes two circular metal members 11 and 12 coaxial with the line of sight LOS between the antenna 2 and the blockage 6. Such circular metal members are supported on a thin metal rod 13 coaxial with the line of sight LOS.

The circular metal members 11, 12, may be circular discs or circular rings. Preferably, the radii of each metal member 11, 12, is between 0.5 and 1.5 times that of the blockage. In addition, the circular metal members 11,12, are spaced from the blockage 6, and also from each other, a distance which is preferably about 0.5 to 1.5 times the middle, or operating wavelength of the antenna.

In the example illustrated in FIG. 1, the radome 4 is a half-wave streamline radome, 12–13$\lambda$ in length, with a fineness ratio of about 2. The metal tip 6 at the nose of the radome is about one half $\lambda$ (the middle frequency of the antenna) in diameter, and its area blocks 10–15% of an x-band antenna aperture. The two circular metal members 11, 12 are identical metallic discs of a diameter of about 0.8 that of the rain tip 6, and are supported on a thin steel rod 13. For an efficient sidelobes blanking in the angular range of 30–60° C. aside of the main beam, both the distance between the first disc 11 and the rain tip, as well as the distance between it and the second disc 12, is $5\lambda/4$.

Figure 3:
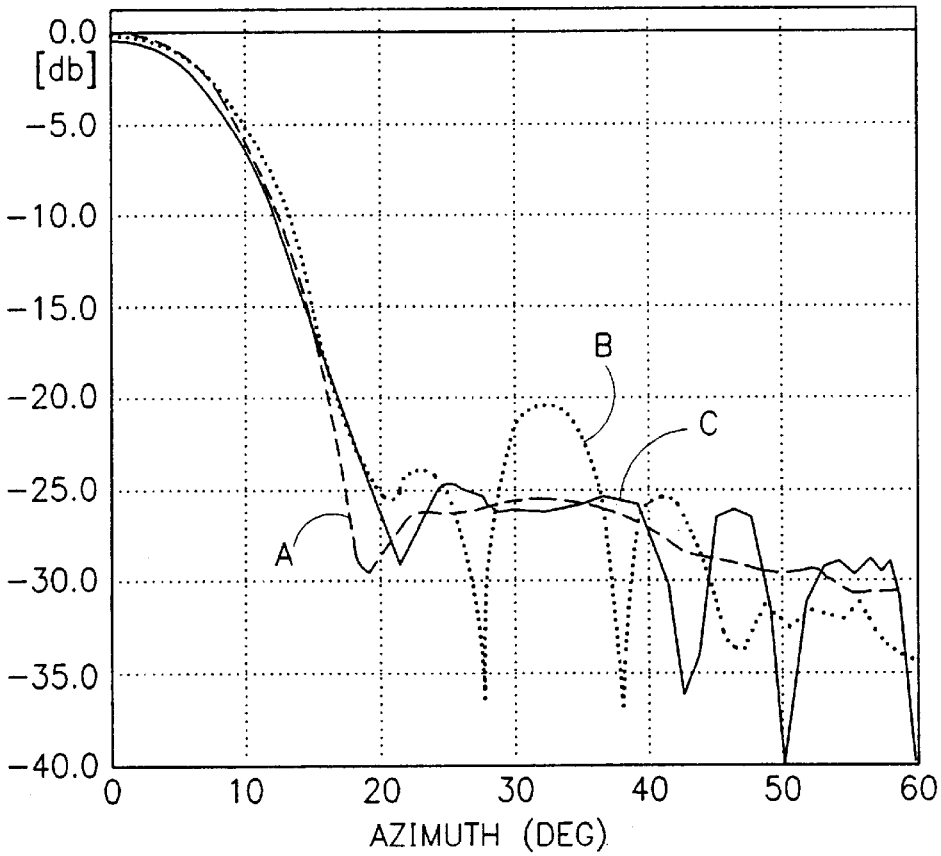
FIG. 3 includes a set of curves illustrating the reduction in the sidelobes produced by the passive tuning elements in the antenna system of FIGS. 1 and 2.

FIG. 3 illustrates the effect such a tuning device 10 has on the H-plane radiation pattern of an x-band antenna covered by a half-wave ogive radome. Thus, curve A (long broken lines) illustrates the radiation pattern of the antenna alone without the radome or the tuning device; curve B (shorter broken lines) illustrates the radiation pattern of the antenna with a radome; and curve C (full lines) illustrates the radiation pattern when the tuning device 10, as described above with respect to FIGS. 1 and 2, is inserted into the radome.

While the invention has been described with respect to one preferred embodiment, it will be appreciated that many other variations, modifications and other applications of the invention may be made.

What is claimed is:

1. A method of reducing sidelobes of an antenna-radome system induced by a blockage in a radome covering the antenna, comprising: providing at least one passive tuning element between the antenna and the blockage, and adjusting the position of said tuning element with respect to the radome-blockage to reduce said blockage-induced sidelobes.

2. The method according to claim 1, wherein said passive tuning element is provided along the line of sight between the antenna and the blockage.

3. The method according to claim 2, wherein said passive tuning element is a metal member coaxial with said line of sight between the antenna and the blockage.

4. The method according to claim 3, wherein said metal member is supported coaxial with said line of sight between the antenna and the blockage.

5. The method according to claim 3, wherein the radius of said metal member is between 0.5 and 1.5 times that of the blockage.

6. The method according to claim 5, wherein there are a plurality of said metal members.

7. The method according to claim 5, wherein the spacing between the metal members from each other is 0.5 to 1.5 times the operating wavelength of the antenna.

8. The method according to claim 7, wherein said metal members are circular discs.

9. The method according to claim 7, wherein said metal members are circular rings.

10. The method according to claim 3, wherein the metal member is spaced from the radome a distance of 0.5 to 1.5 times the operating wavelength of the antenna.

11. The method according to claim 3, wherein said metal member is a circular disc.

12. The method according to claim 3, wherein said metal member is a circular ring.

13. Antenna apparatus, comprising: an antenna; a randome covering the antenna and including a blockage tending to induce sidelobes in the radiation pattern of the antenna; and at least one passive tuning element between the antenna and the blockage for reducing said blockage-induced sidelobes, said tuning element positioned with respect to the blockage.

14. The apparatus according to claim 13, wherein the position of the passive tuning element is adjustable between the antenna and the blockage.

15. The apparatus according to claim 14, wherein said passive tuning element is provided along the line of sight between the antenna and the blockage.

16. The apparatus according to claim 15, wherein said passive tuning element is a metal member coaxial with said line of sight between the antenna and the blockage.

17. The apparatus according to claim 16, wherein said metal member is supported coaxial with said line of sight between the antenna and the blockage.

18. The apparatus according to claim 16, wherein the radius of said metal member is between 0.5 and 1.5 times that of the blockage.

19. The apparatus according to claim 18, wherein there are a plurality of said metal members.

20. The apparatus according to claim 19, wherein the spacing between the metal members from each other is 0.5 to 1.5 times the operating wavelength of the antenna.

21. The apparatus according to claim 20, wherein said metal members are circular discs.

22. The apparatus according to claim 20, wherein said metal members are circular rings.

23. The apparatus according to claim 16, wherein the metal member is spaced from the radome a distance of 0.5 to 1.5 times the operating wavelength of the antenna.

24. The apparatus according to claim 16, wherein said metal member is a circular disc.

25. The apparatus according to claim 16, wherein said metal member is a circular ring.

26. The apparatus according to claim 13, wherein said blockage is of metal at the tip of the radome.

* * * * *